US011254497B2

(12) United States Patent
Nolet et al.

(10) Patent No.: US 11,254,497 B2
(45) Date of Patent: Feb. 22, 2022

(54) SEALED GRAB BAR AND A CONTAINER PROVIDED THEREWITH

(71) Applicant: IPL INC., St-Damien (CA)

(72) Inventors: Roch Nolet, St-Joseph-de-Beauce (CA); Francis Côté, Lévis (CA)

(73) Assignee: IPL INC.

( * ) Notice: Subject to any disclaimer, the term of this patent is extended or adjusted under 35 U.S.C. 154(b) by 0 days.

(21) Appl. No.: 16/429,579

(22) Filed: Jun. 3, 2019

(65) Prior Publication Data

US 2019/0382199 A1 Dec. 19, 2019

Related U.S. Application Data

(60) Provisional application No. 62/684,977, filed on Jun. 14, 2018.

(51) Int. Cl.

| | |
|---|---|
| ***B65F 1/14*** | (2006.01) |
| ***B65F 1/02*** | (2006.01) |
| ***B65F 1/16*** | (2006.01) |

(52) U.S. Cl.

CPC ..... *B65F 1/1452* (2013.01); *B65F 1/02* (2013.01); *B65F 1/16* (2013.01); *B65F 2220/124* (2013.01); *B65F 2250/1143* (2013.01)

(58) Field of Classification Search

CPC ..... B65F 1/16; B65F 1/1473; B65F 1/1468; B65F 1/14; B65F 1/125; B65F 1/12;

(Continued)

(56) References Cited

U.S. PATENT DOCUMENTS

D291,739 S 9/1987 Orlowski
4,749,101 A * 6/1988 Durkan, Jr. ..... B65F 1/1646 220/840

(Continued)

FOREIGN PATENT DOCUMENTS

CA 2624658 A1 9/2009
CA 2624663 A1 9/2009

(Continued)

OTHER PUBLICATIONS

CASCADE Waste and Recycling Carts; http://www.cascadecartsolutions.com/products/waste-recycling-carts/icon-series; Dec. 14, 2012.

(Continued)

*Primary Examiner* — Kareen K Thomas

(74) *Attorney, Agent, or Firm* — Lavery, De Billy, LLP; Gwendoline Bruneau

(57) ABSTRACT

A container and a method of fabrication thereof, the container comprising side walls, a front wall and a back wall, the walls extending from a base wall to a top edge of the container, and defining an inner cavity, wherein the front wall comprises an upper part and a lower part recessed inward from the upper part, the lower part comprising facing walls extending inwardly from an external surface of the upper part to a recessed wall, the facing walls and the recessed wall extending downwardly to the base wall; each one of the two facing walls supporting an engaging element, the two engaging elements facing each other; and a grab bar is secured in rotation between the two facing walls, a first end thereof engaging with a first one of the engaging elements and a second end thereof engaging with a second one of the engaging elements.

7 Claims, 20 Drawing Sheets

(58) Field of Classification Search
CPC .. B65F 1/1452; B65F 1/02; B65F 2250/1143; B65F 2220/124; B65F 3/048; B65F 1/122; B65D 43/26; B65D 2501/24987; B65D 2519/00781
See application file for complete search history.

(56) References Cited

U.S. PATENT DOCUMENTS

| | | | | |
|---|---|---|---|---|
| 4,836,394 | A * | 6/1989 | Glomski | B65F 1/1646 220/263 |
| D313,491 | S | 1/1991 | Edelhoff et al. | |
| 5,251,780 | A | 10/1993 | Lee | |
| D355,741 | S | 2/1995 | Craft et al. | |
| D365,428 | S | 12/1995 | Prout et al. | |
| D398,120 | S | 9/1998 | Rehrig et al. | |
| D410,125 | S | 5/1999 | Rehrig et al. | |
| D429,398 | S | 8/2000 | Wysocki | |
| D445,228 | S | 7/2001 | Apps et al. | |
| D470,989 | S | 2/2003 | Tuduri | |
| D474,319 | S | 5/2003 | Tuduri | |
| D477,899 | S | 7/2003 | Tuduri | |
| D478,197 | S | 8/2003 | Raghunathan | |
| D491,328 | S | 6/2004 | Aiken et al. | |
| 7,070,064 | B1 | 7/2006 | Henry et al. | |
| 7,121,564 | B2 | 10/2006 | Hassell | |
| D532,173 | S | 11/2006 | Aiken et al. | |
| D535,448 | S | 1/2007 | Kilduff et al. | |
| 7,172,088 | B2 | 2/2007 | McDade et al. | |
| D564,722 | S | 3/2008 | Hogarth et al. | |
| D577,170 | S | 9/2008 | Meers | |
| D624,723 | S | 9/2010 | Raghunathan et al. | |
| D634,912 | S | 3/2011 | Pouliot et al. | |
| D641,121 | S | 7/2011 | Rampton et al. | |
| D643,174 | S | 8/2011 | Raghunathan et al. | |
| D646,037 | S | 9/2011 | Arthurson | |
| 8,141,455 | B2 | 3/2012 | Ogburn | |
| D657,106 | S | 4/2012 | Pouliot et al. | |
| D659,338 | S | 5/2012 | Gardner | |
| 8,424,714 | B2 | 4/2013 | Kruse et al. | |
| 8,430,267 | B2 | 4/2013 | Kilduff et al. | |
| 9,045,257 | B2 | 6/2015 | Nolet et al. | |
| 9,975,694 | B1 * | 5/2018 | Foster | B65F 1/1452 |
| 2003/0155366 | A1 | 8/2003 | Raghunathan | |
| 2003/0213808 | A1 | 11/2003 | Berger | |
| 2004/0074913 | A1 | 4/2004 | McDade et al. | |
| 2008/0094224 | A1 * | 4/2008 | Parker | B65F 1/1646 340/572.8 |
| 2009/0127809 | A1 * | 5/2009 | Meers | B65F 1/16 280/47.26 |
| 2009/0223965 | A1 | 9/2009 | Raghunathan et al. | |
| 2010/0230427 | A1 | 9/2010 | Parker et al. | |
| 2011/0049151 | A1 | 3/2011 | Raghuthanan et al. | |
| 2011/0049152 | A1 | 3/2011 | Raghuthanan et al. | |
| 2013/0048654 | A1 | 2/2013 | Kilduff et al. | |
| 2013/0067868 | A1 | 3/2013 | Daudelin | |
| 2013/0119625 | A1 * | 5/2013 | Foster | B65F 1/14 280/43 |
| 2013/0234409 | A1 * | 9/2013 | Lin | B65F 1/1607 280/47.26 |
| 2014/0299619 | A1 * | 10/2014 | Foster | E05B 65/006 220/820 |
| 2017/0210558 | A1 * | 7/2017 | Boyea | B65F 1/04 |

FOREIGN PATENT DOCUMENTS

| | | | |
|---|---|---|---|
| CA | 2636306 | A1 | 9/2009 |
| CA | 2860131 | A1 | 2/2015 |

OTHER PUBLICATIONS

Otto Roll-out carts; http://ottoenvironmentalsystems.thomasnet-navigator.com/category/residential-refuse-and-recycling-carts; Dec. 12, 2012.

Rehrig Roll-Out Carts; http://www.rehrigpacific.com/products-and-services/waste-recycling-and-public-works/roll-out-carts-and-recycle-bins/roll-out-carts; Dec. 14, 2012.

Schaefer 2 wheel containers; http://www.ssi-schaefer.us/waste-management/waste-management-products/2-wheel-containers.html; Dec. 14, 2012.

Sulo; Two-wheeled roll-out cart; http://www.sulo.com.au/products/two-wheeled-2-wheelie-bin-mgb/; Dec. 14, 2014.

Toter Curbside Collection Carts, roll-out carts; http://www.toter.com/products/product-detail.cfm?product_id=F5949571-A635-17A8-0DBCEC04461A60F9; Dec. 14, 2012.

Environmental Industry Associations for Equipment Technology and Operations for Wastes and Recyclable Materials, Waste Containers—Compatibility Dimensions; Waste Equipment Technology Association (2008).

* cited by examiner

SEALED GRAB BAR AND A CONTAINER PROVIDED THEREWITH

CROSS REFERENCE TO RELATED APPLICATIONS F

This application claims benefit of U.S. provisional application Ser. No. 62/684,977, filed on Jun. 14, 2018. All documents above are incorporated herein in their entirety by reference.

FIELD OF THE INVENTION

The present disclosure relates to a container with a grab bar. More specifically, the present disclosure is concerned with a grab bar and a container provided therewith.

SUMMARY OF THE INVENTION

More specifically, in accordance with the present invention, there is provided a stackable container with a grab bar in complete fluid isolation from an inner cavity of the container and comprising a base wall, walls extending from the base wall to an open end and defining the inner cavity, a grab bar; the grab bar comprising a body with opposite ends; wherein a pair of facing walls extends inwardly from an external surface of one of the walls extending from the base wall to a recessed wall, the facing walls and the recessed wall extending downwardly to the base wall, each one of the facing walls comprising an engaging element, the two engaging elements facing each other at a distance from the external surface of the wall; at least a first one of said facing walls being adapted to flex outward from a second one of said facing walls into a grab bar securing position in which a first one of the engaging elements engages with a first end of the body of the grab bar and a second one of the engaging elements engages with a second end of the body of the grab bar; and the at least first one of the facing walls being adapted to be released to an operating position in which the grab bar is secured between the two facing walls at the distance from the bin relative to the external surface of the first wall.

There is further provided a method for making a stackable container with a grab bar in complete fluid isolation from an inner cavity of the container, the container comprising a base wall and walls extending from the base wall to an open end and defining the inner cavity, the method comprising providing a first one of the walls extending from the base wall with a recess formed by a pair of facing walls extending inwardly from an external surface of the first wall to a recessed wall, the facing walls and the recessed wall extending downwardly to the base wall; providing each one of the two facing walls with an engaging element at a given distance from the external surface of the recessed wall within the recess; flexing a first one of the facing walls outwards from the second one the facing walls, engaging a first one of the engaging elements with a first end of the grab bar and a second one of the engaging elements with a second end of the grab bar; and releasing the facing walls to an operating position in which the grab bar is secured between the two facing walls at the given distance from the bin relative to the external surface of the recessed wall.

There is further provided a container comprising side walls, a front wall and a back wall, the walls extending from a base wall to a top edge of the container, and defining an inner cavity, wherein the front wall comprises an upper part and a lower part recessed inward from the upper part, the lower part comprising facing walls extending inwardly from an external surface of the upper part to a recessed wall, the facing walls and the recessed wall extending downwardly to the base wall; each one of the two facing walls supporting an engaging element, the two engaging elements facing each other; and a grab bar is secured in rotation between the two facing walls, a first end thereof engaging with a first one of the engaging elements and a second end thereof engaging with a second one of the engaging elements.

Other objects, advantages and features of the present invention will become more apparent upon reading of the following non-restrictive description of specific embodiments thereof, given by way of example only with reference to the accompanying drawings.

DESCRIPTION OF ILLUSTRATIVE EMBODIMENTS

The present invention is illustrated in further details by the following non-limiting examples.

Figure 1:
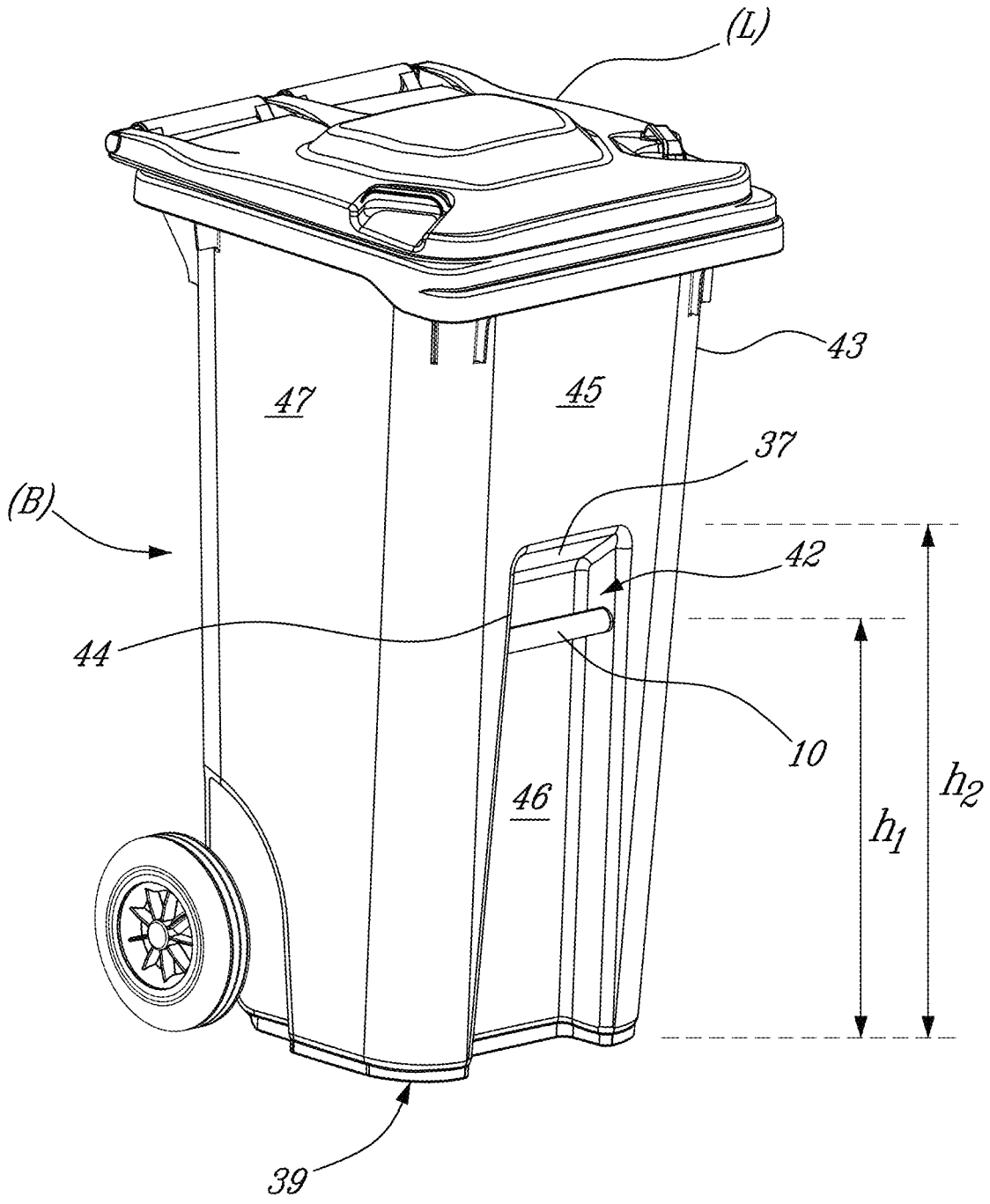
FIG. 1 is a perspective view of a container according to an embodiment of an aspect of the present disclosure.

FIG. 1 shows a container comprising a bin (B) defining an inner cavity, and a lid (L) rotatably connected to the bin (B) at a first end thereof and movable between an open position (not shown) giving access to the inside of the cavity and a closed position, illustrated in FIG. 1, preventing access to the inside of the cavity for example.

The bin (B) comprises a base wall 39, and lateral walls including side walls 43, 47, a front wall 45 and a back wall 47, extending from the base 39, defining the an inner cavity.

The front wall 45 of the bin (B) comprises a recess formed laterally by two facing walls 42, 44 extending inwardly from the surface of the front wall 45 of the bin (B), at a height h2 from the base 39, to a recessed wall 46, the recessed wall 46, as well as the two facing walls 42, 44, extending from this height h2 from the base 39 to said base 39 each in a same plane. A grab bar 10 extends between the two facing walls 42, 44, at a distance (d) from the external surface of the recessed wall (see FIG. 6).

The grab bar 10 comprises a generally tubular body 12, which may be hollow as illustrated, with ends 20, 22.

Figure 8A:
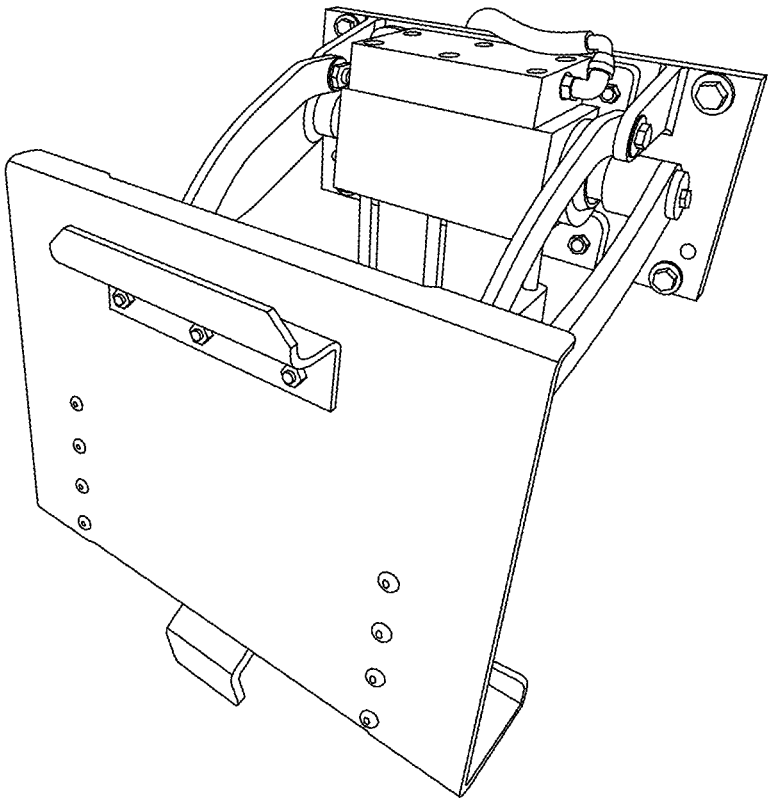
FIGS. 8A, 8B and 8C show steps of pulling-out test on a grad bar according to an embodiment of an aspect of the present disclosure.
Figure 8B:
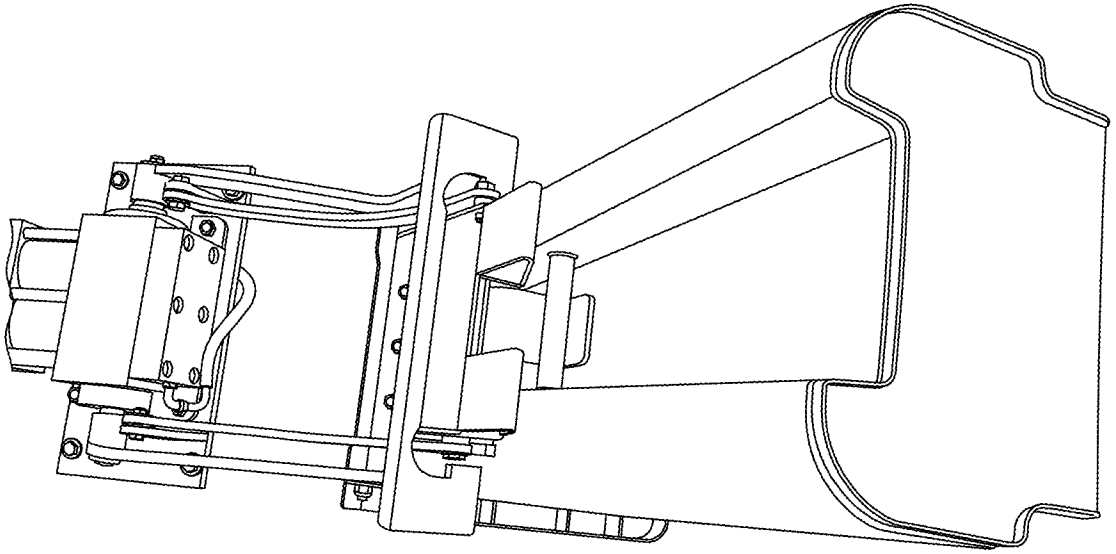
Figure 8C:
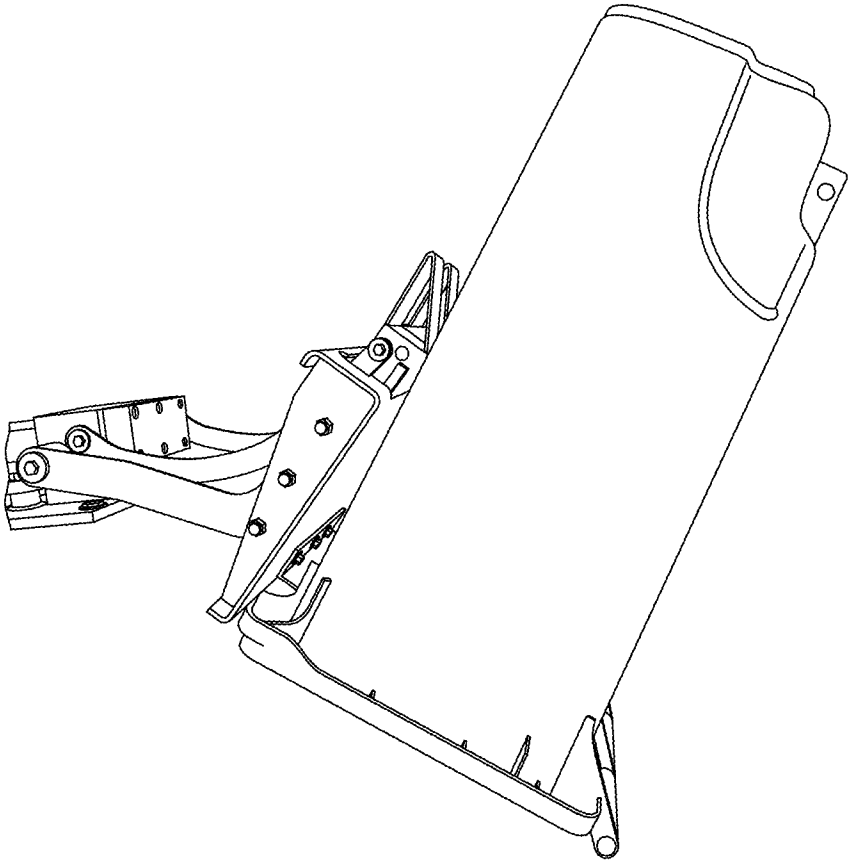
Figure 9A:
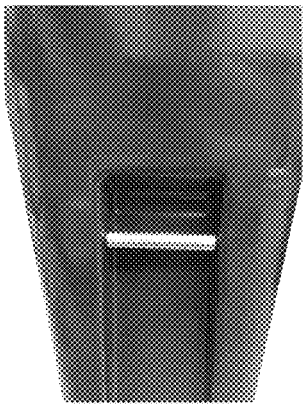
FIGS. 9A-9Q show results of resistance to the pulling-out test on a grad bar according to an embodiment of an aspect of the present disclosure.
Figure 9B:
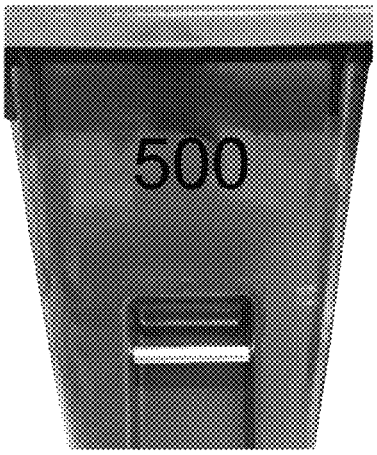
Figure 9C:
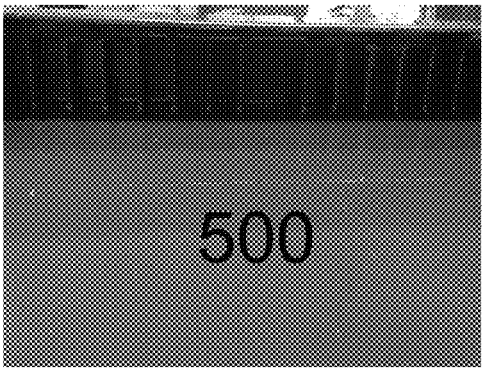
Figure 9D:
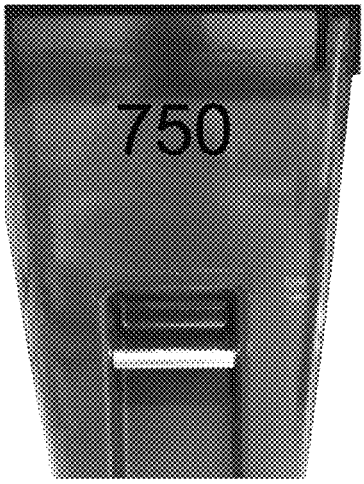
Figure 9E:
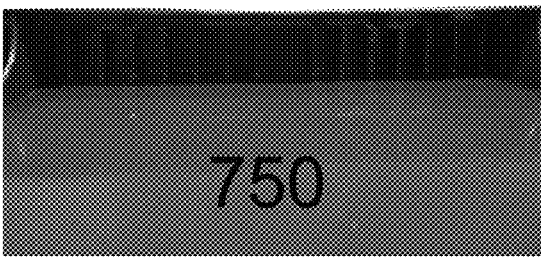
Figure 9F:
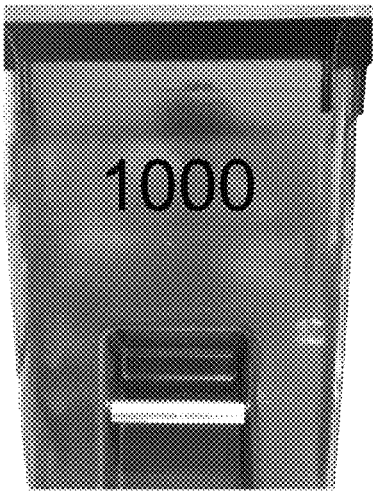
Figure 9G:
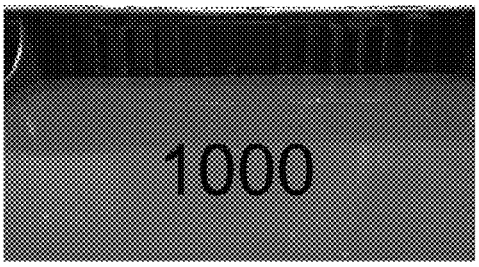
Figure 9H:
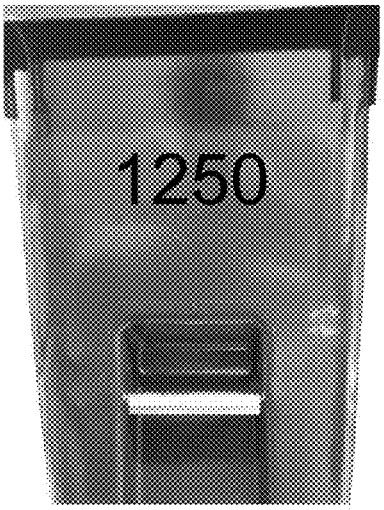
Figure 9I:
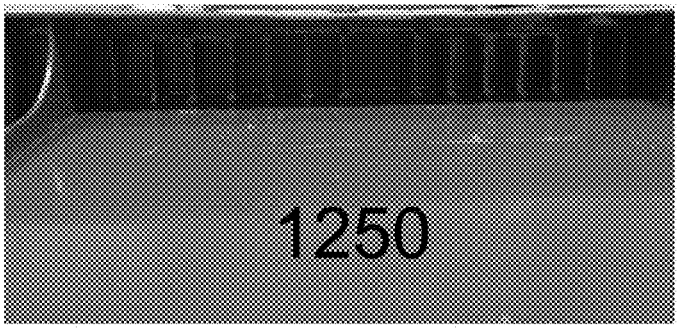
Figure 9J:
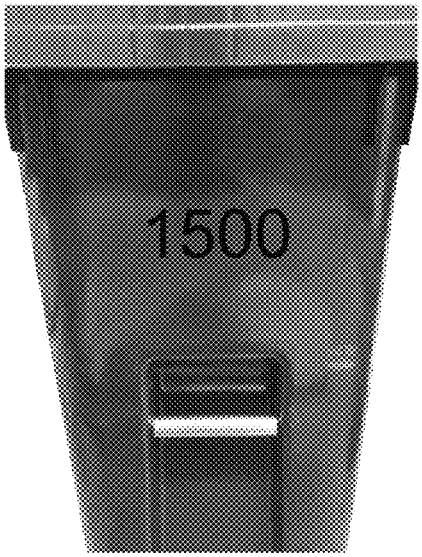
Figure 9K:
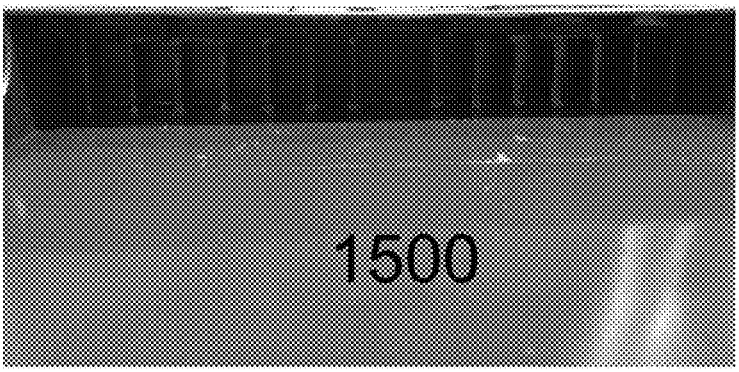
Figure 9L:
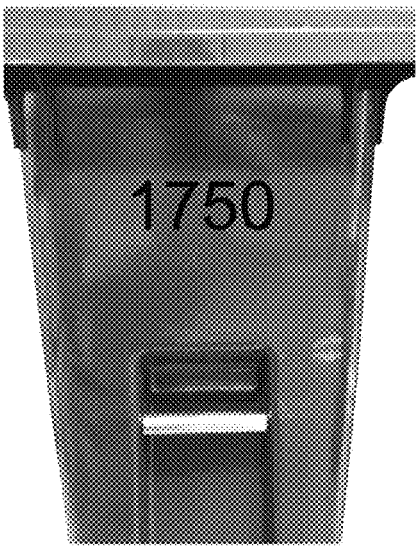
Figure 9M:
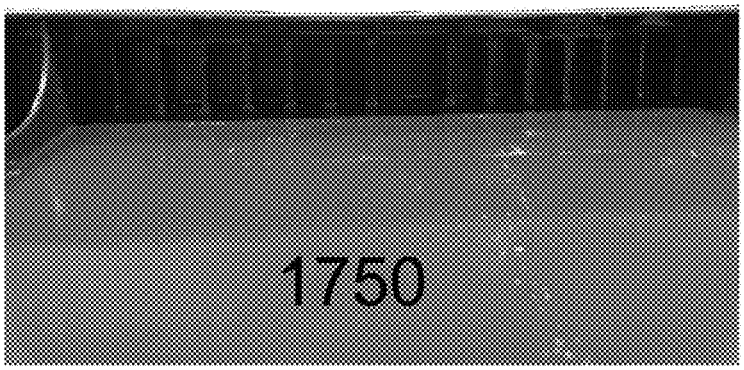
Figure 9N:
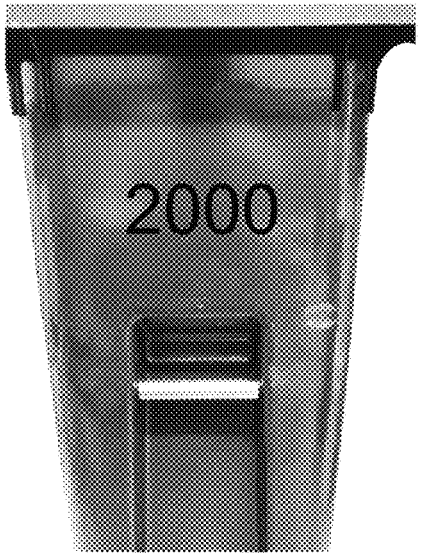
Figure 9O:
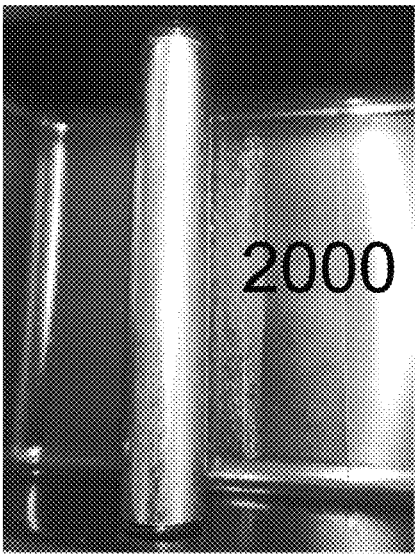
Figure 9P:
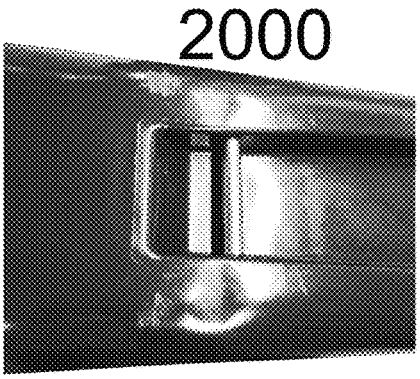
Figure 9Q:
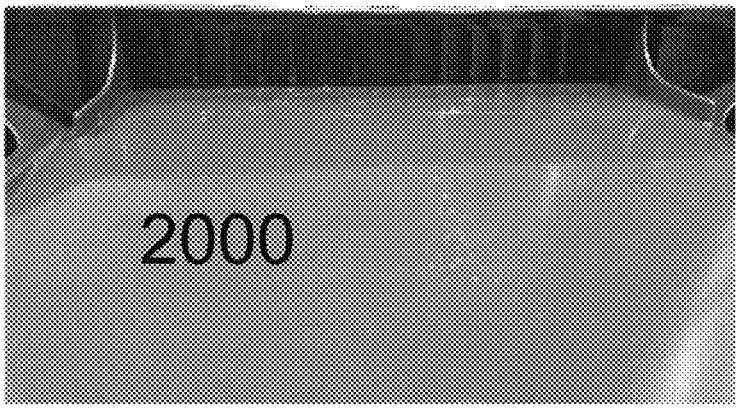

As illustrated for example in FIGS. 2, 3, 4 and 5, each facing wall 42, 44 comprises an engaging element, such a male element such as a protuberance or a knob 24, 26 for example, within the recess formed by the two facing walls 42, 44 and the recessed wall 46 as discussed hereinabove, at the distance (d) from the external surface of the recessed wall 46 (see FIG. 6), at a height (h2) relative to the base 39 of the bin (B), i.e. facing each other so as to provide a rotation axis for the grab bar at the height (h1) relative to the base 39 of the bin (B). The height (h1) is typically selected so that the distance h=h2-h1 between the rotation axis for the grab bar and the top 37 of the recess formed by the facing walls 42, 44 and the recessed wall 46 allows rotation of the grab bar and gripping the grab bar (see for example FIG. 8C).

The engaging element 24, 26 may be a male element, such as ring as illustrated herein or a disk or a knob, projecting from an outer surface of the wall 42, 44. Each male element 24, 26 has a length (H) from the outer surface of its respective wall 42, 44 (see FIG. 4). The grab bar 10 as a length of at most a distance separating the two facing walls 42, 44, and at least a distance separating the facing free ends of the knobs 24, 26.

Alternatively, the engaging element 24, 26 may be a female element, i. e. a recess within the thickness of the facing wall 42, 44, adapted for receiving the ends 20, 22 of the grab bar.

The two facing walls 42, 44 extending outwardly from an external surface of the front wall 46 of the bin (B) are flexible between a grab bar insertion position and an operating position of the bin (B) as will be described hereinafter in relation to FIGS. 5-7 for example.

The respective length of the grab bar 10 and of each one of the knobs 24, 26 are selected to provide engagement of the knobs within the open ends 20, 22 of the bar 10 once the walls 42, 44 are released to the operating position of the bin (B), so that the bar 10 does not disengage therefrom upon use of the container, as will be discussed hereinbelow.

The knobs 24, 26 may be integrally molded with the bin (B).

Figure 5:
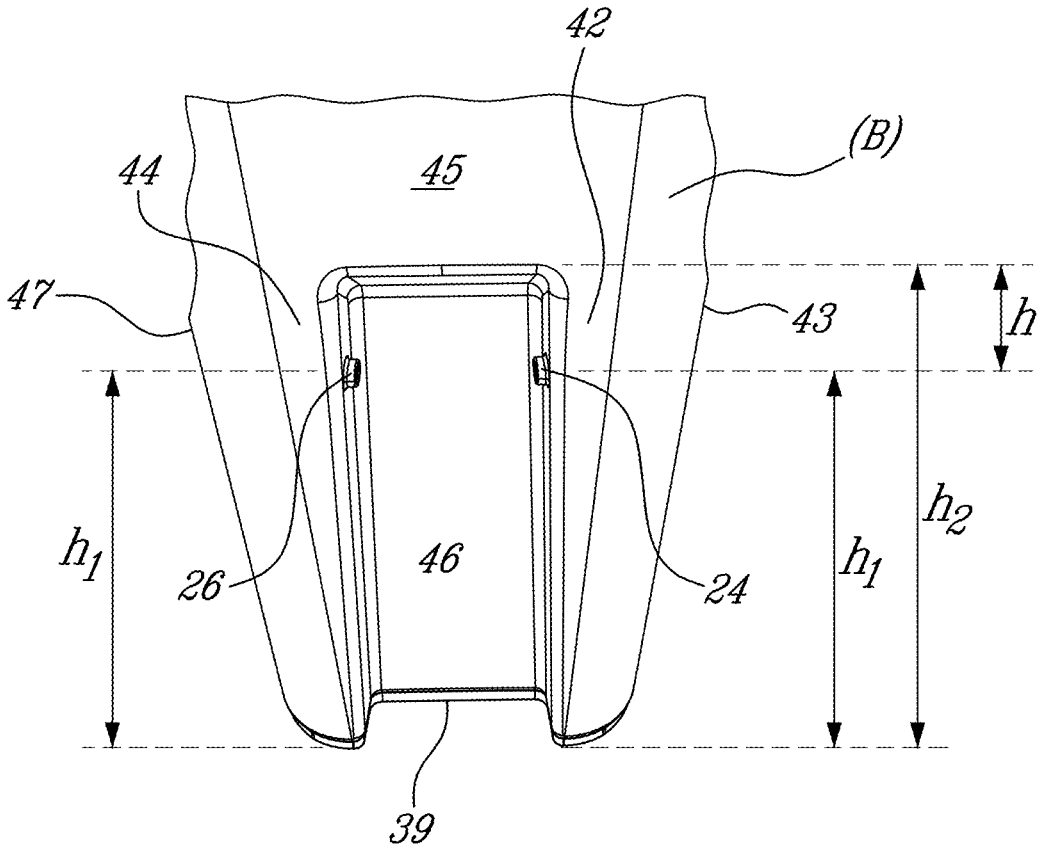
FIG. 5 shows a container before securing a grad bar thereto according to an embodiment of an aspect of the present disclosure.
Figure 6:
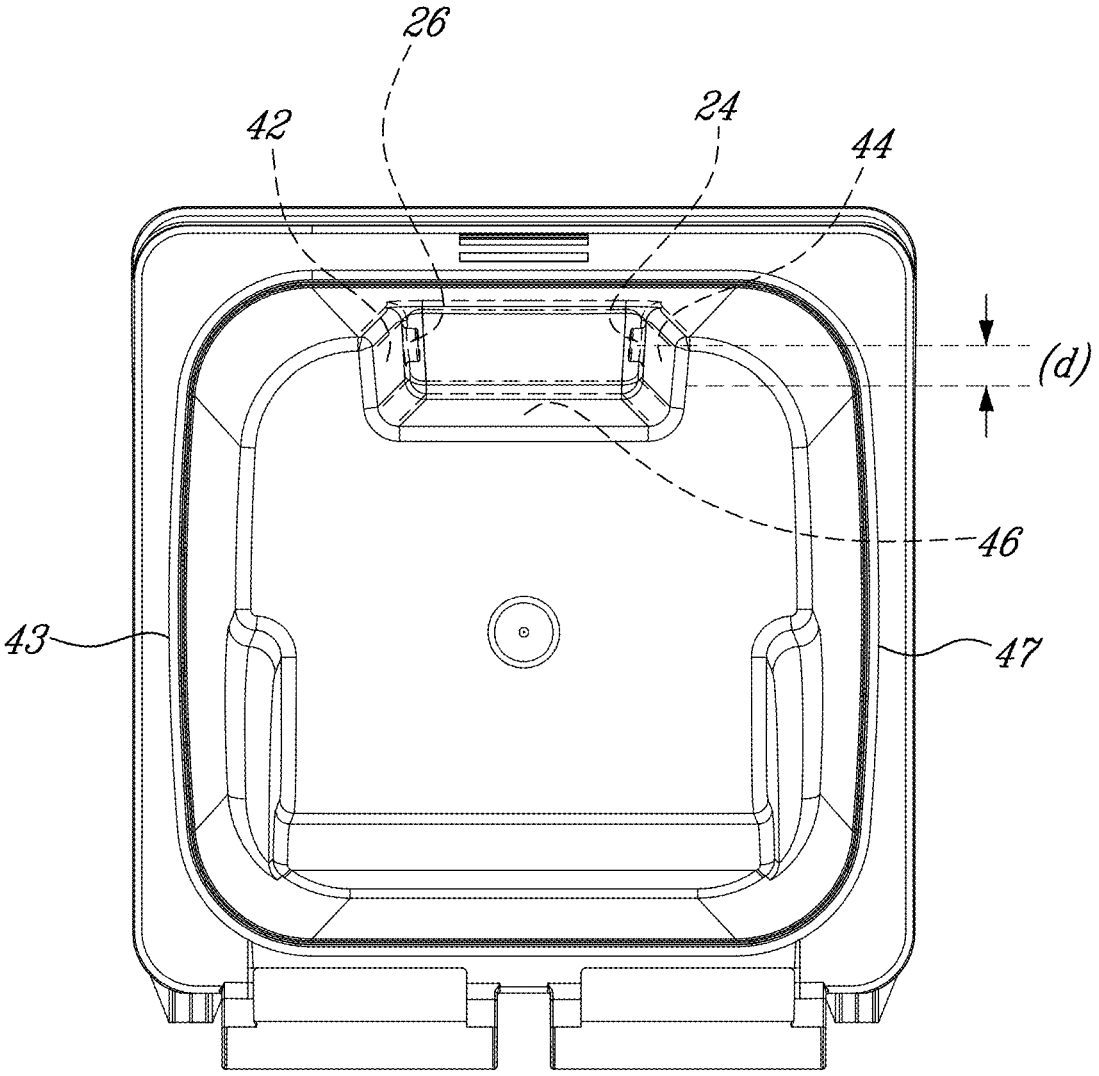
FIG. 6 is a top view showing connection of a grad bar to a container according to an embodiment of an aspect of the present disclosure.
Figure 7:
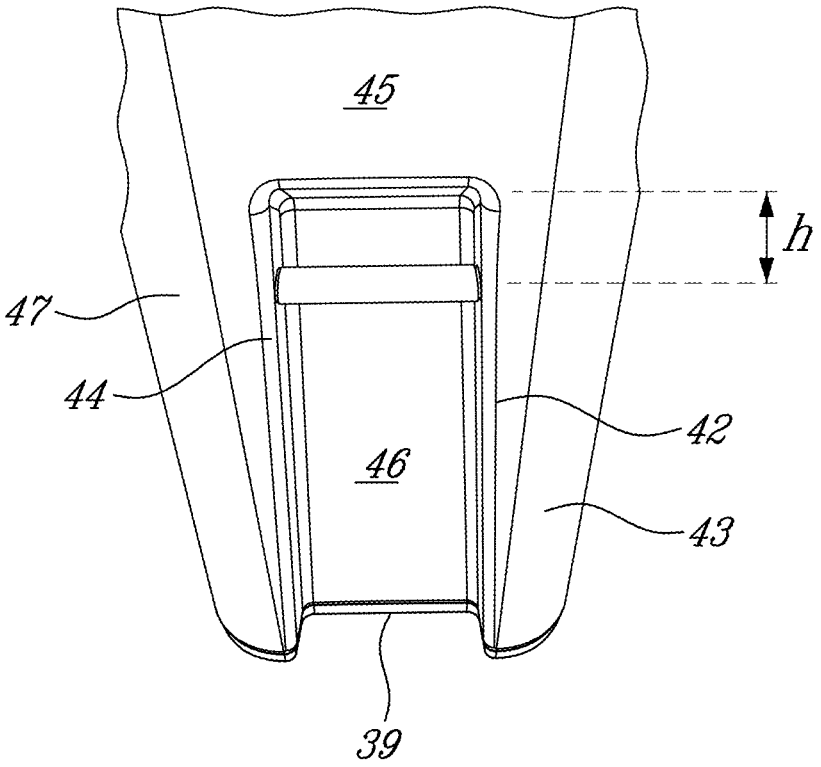
FIG. 7 shows the container of FIG. 5 after securing the grad bar thereto according to an embodiment of an aspect of the present disclosure.

As shown in FIGS. 5-7 for example, when the bin (B) formed with knobs 24, 26 is just removed from the mold, before complete cooling thereof, the facing walls 42, 44 may be manually flexed outwards from one another so as to be pulled apart from one other (see arrows in FIG. 6), into the grab bar insertion position allowing inserting the grab bar 10 therebetween and engaging the knobs 24, 26 within the respective open ends 20, 22 of the grab bar 10. Once the demolded bin is cooled and mold shrinkage has occurred, the facing walls 42, 44 may still be flexed outwards by force, using a tool for example.

Once the grab bar 10 is secured within the space between the two facing walls 42, 44 and the separating pressure between the two facing walls 42, 44 is released (see FIG. 7), in the operating position of the bin (B), the bar 10 is secured in rotation between the two facing walls 42, 44 and in complete fluid isolation from the cavity, i.e. from the inside of the bin (B) of the container, the walls forming the inner cavity being all exempt of aperture to the exterior of the bin.

Figure 2:
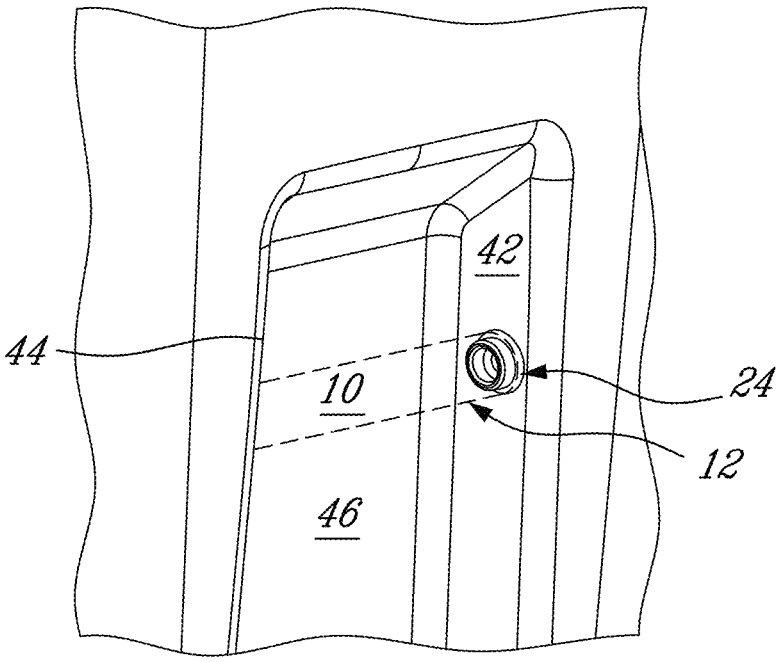
FIG. 2 is a detail of the front wall of the container of FIG. 1.
Figure 3:
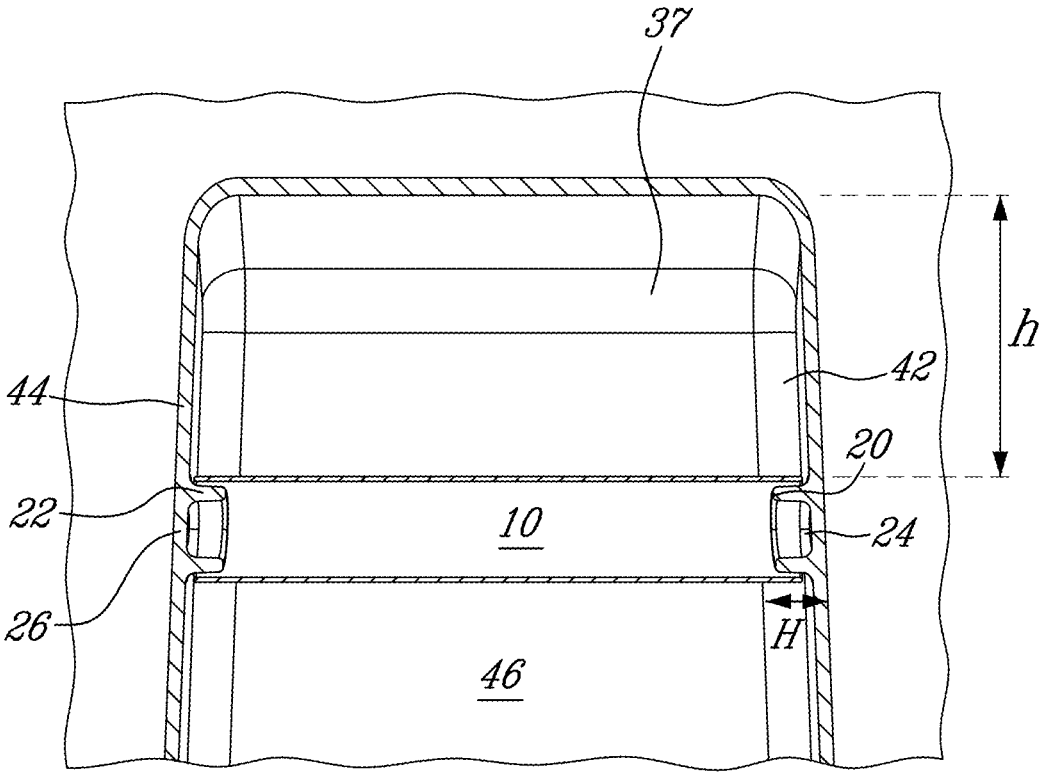
FIG. 3 is a sectional view of the grab of FIG. 2.
Figure 4:
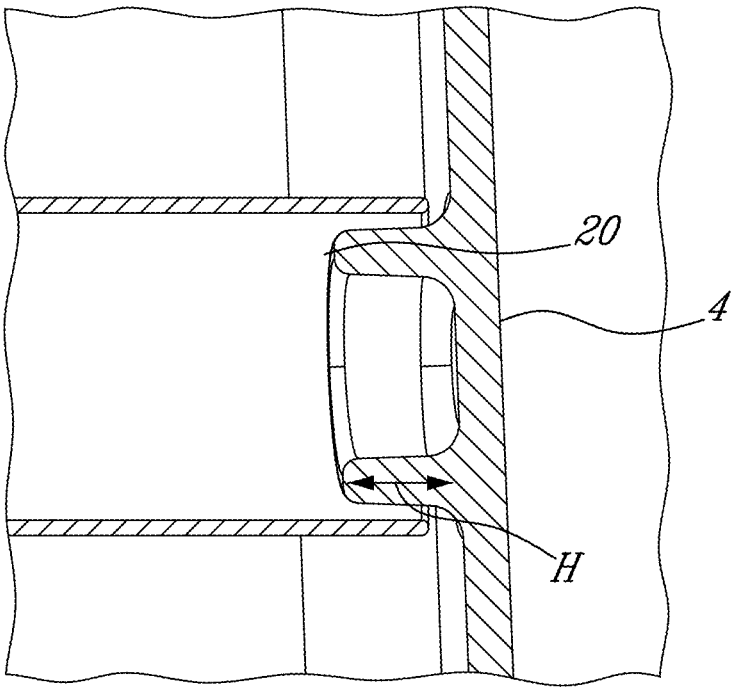
FIG. 4 shows a detail of FIG. 3.

In the operating position of the bin (B), the bar 10 is locked into position to the bin (B), while free in rotation about the rotation axis formed by the facing elements 24, 26 within the space between the two facing walls 42, 44, entirely externally from the inside of the bin (B) (see FIGS. 3, 4, 6), and each wall 42, 44 defines a same plane above and below the bar 10 (see FIGS. 1, 2). As a result, as may be seen from FIG. 6, the bar connection region of the bin does not interfere when stacking containers one inside the other.

The bar 10 is in complete fluid isolation from the cavity, i.e. from the inside of the bin (B) of the container 100, so that when the container is tipped over for discharging from the front thereof in the open position of the lid (L), there is no spilling of leachate from side walls of the bin (B).

The bin is typical injected molded in polyethylene for example. The grab bar may be a rolled metal member, or a pultruded or extruded plastic member for example.

FIG. 9. show results of tests of resistance to pulling-out of a metal grab bar according to an embodiment of an aspect of the present disclosure, when submitted to rough handling by garbage truck automated arms as known in the art. The tests consisted in cycles of handling with a Bayne truck automated arm operated a pressure of about 1500 psi, using an empty bin positioned within the automated arm (see FIG. 8). An emptying cycle was started, in conditions of extreme shaking, i.e. rough handling preventing full cycles, thereby only allowing abrupt and interrupted and accelerated cycles. The test was stopped every 250 cycles to assess the damages to the bin, and, in absence of crevices on the front wall of the bin, for example in the area of the recess formed by the two facing walls 42, 44, the test was resumed. FIG. 9 show the front wall of a bin thus tested, after 250, 500, 750, 1000, 1250, 1500, and 2000 cycles. As can be seen, the surface finish of the grab bar was only merely altered and no fatigue ou crevice could be seen on the bin.

Figure 10A:
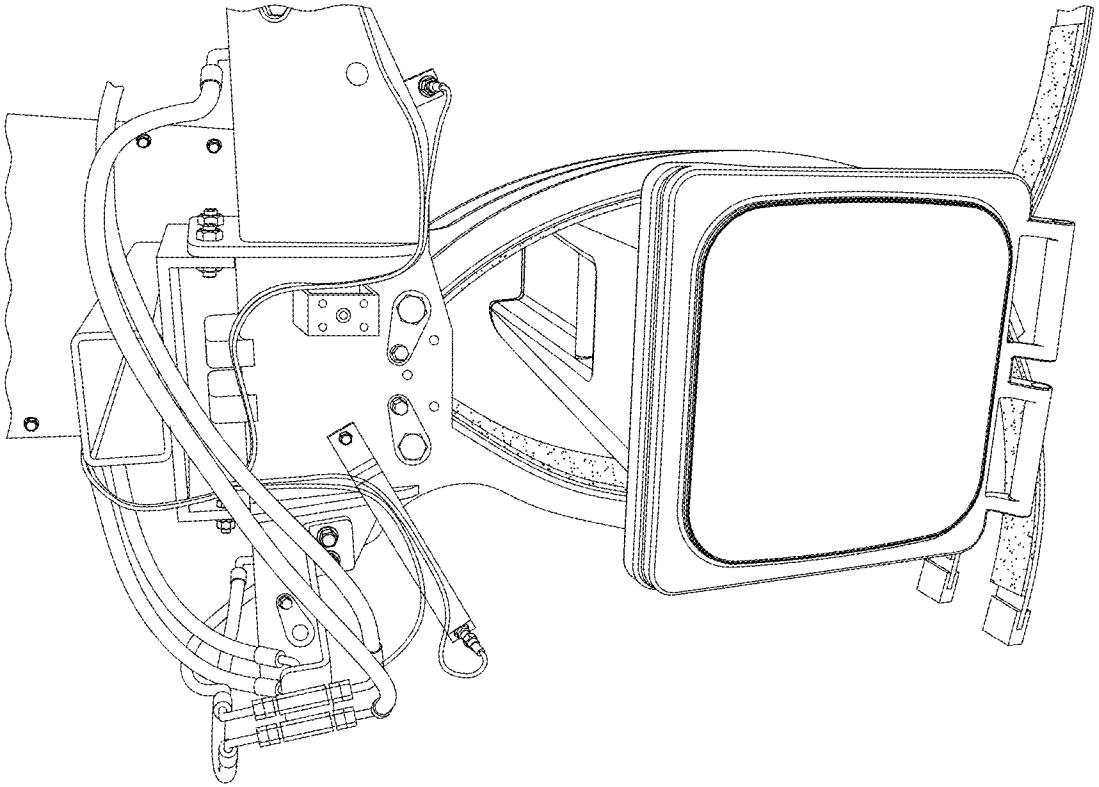
FIGS. 10A-10B show handling of a bin by an automated arm at different angles according to an embodiment of an aspect of the present disclosure.
Figure 10B:
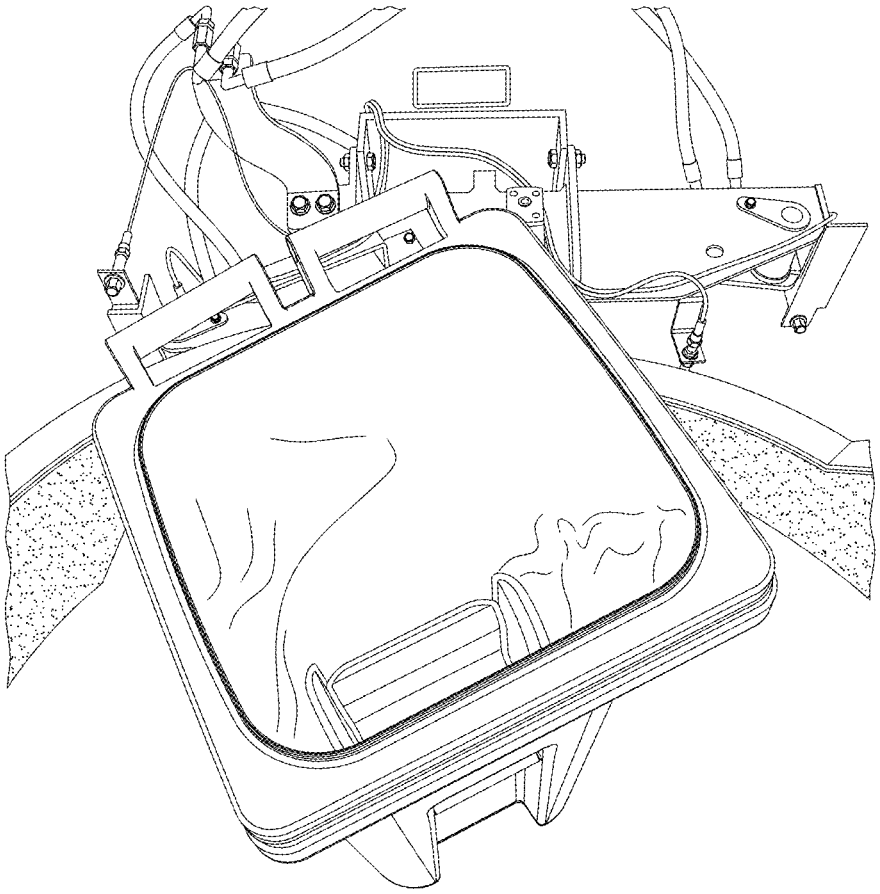
Figure 11A:
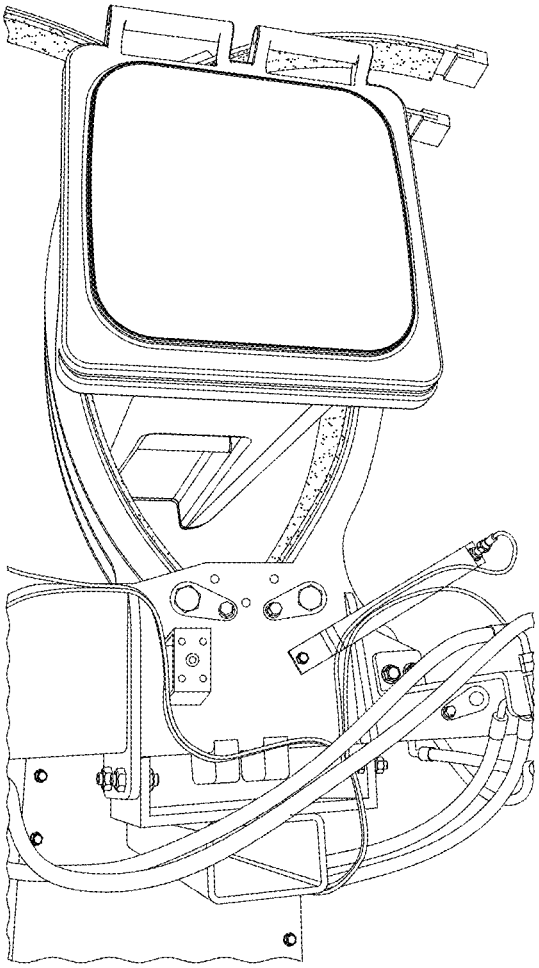
FIGS. 11A-11B show handling of a bin by an automated arm at different angles according to an embodiment of an aspect of the present disclosure.
Figure 11B:
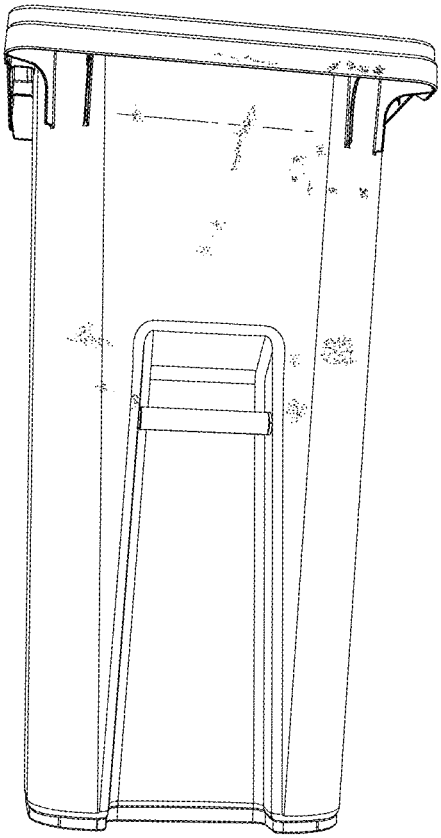
Figure 12A:
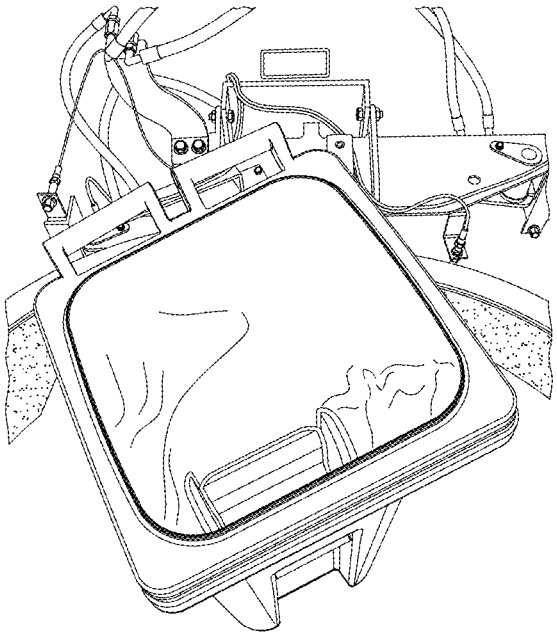
FIGS. 12A-12B show handling of a bin by an automated arm at different angles according to an embodiment of an aspect of the present disclosure.
Figure 12B:
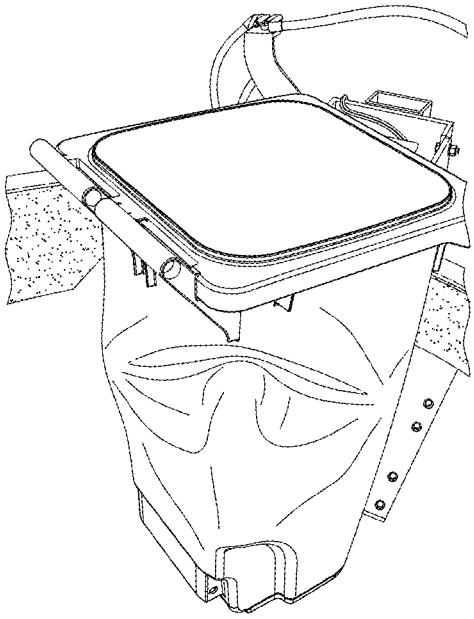
Figure 13A:
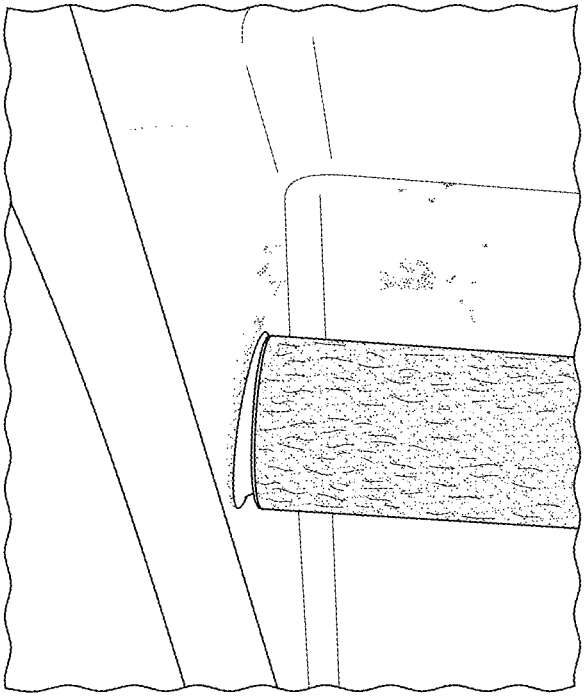
FIGS. 13A-13B show handling of a bin by an automated arm at different angles according to an embodiment of an aspect of the present disclosure.
Figure 13B:
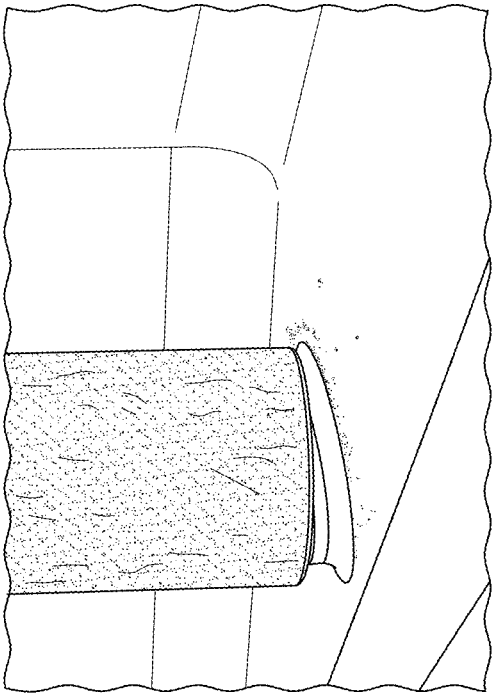

Another series of tests were performed to assess whether a metal grab bar according to an embodiment of an aspect of the present disclosure withstands handling of the bin by an automated arm picking the bin up at an angle of 45 degrees (see FIG. 10 B and FIG. 12) as opposed to the normal pickup up position (See FIG. 10A and FIG. 11). For a pick up at 45 degrees although the bin deforms, the grab bar remains in place and connected to the bin by the knobs 24, 26 at the end of 260 cycles (FIG. 13). Note that the bin used for these tests was the same as previously used for the grab bar pull-out test described hereinabove in relation to FIGS. 8-9, and has therefore already been submitted to rough handling.

The scope of the claims should not be limited by the embodiments set forth in the examples, but should be given the broadest interpretation consistent with the description as a whole.

The invention claimed is:

1. A stackable container with a grab bar in complete fluid isolation from an inner cavity of the container, the container comprising:

a base wall;

walls extending from the base wall to an open end and defining the inner cavity;

a grab bar; said grab bar comprising a body with opposite ends;

wherein a pair of facing walls extends inwardly, from an external surface of a first one of said walls extending from the base wall, to a recessed wall, said facing walls and said recessed wall extending downwardly to the base wall, each one of said facing walls comprising a non-deformable engaging element, the two engaging elements facing each other on a rotation axis of the grab bar at a distance from said external surface of said first wall, at least a first one of said facing walls being adapted to flex outward from a second one of said facing walls into a grab bar securing position in which a first one of the engaging elements engages with a first end of the body of the grab bar and a second one of the engaging elements engages with a second end of the body of the grab bar; and said at least first one of said facing walls being adapted to be released to an operating position in which the grab bar is secured in rotation between the two facing walls at said distance from the bin relative to the external surface of said wall.

2. The container of claim 1, wherein said facing walls are integrally molded with the base wall and the walls extending from the base wall.

3. The container of claim 1, wherein said engaging elements are integrally molded with the base wall and the walls extending from the base wall.

4. The container of claim 1, wherein said engaging elements are rings.

5. The container of claim 1, wherein said engaging elements are disks.

6. The container of claim 1, wherein said engaging elements are male elements, said grab bar has a length from a first open end thereof to a second open end thereof of at most a distance separating the two facing walls, and of at least a distance separating facing free ends of the male elements.

7. A container comprising side walls, a front wall and a back wall, said walls extending from a base wall to a top edge of the container, and defining an inner cavity, wherein said front wall comprises an upper part and a lower part recessed inward from said upper part, said lower part comprising facing walls extending inwardly from an external surface of said upper part to a recessed wall, the facing walls and the recessed wall extending downwardly to the base wall;

each one of the facing walls supporting a non-deformable engaging element, the two engaging elements facing each other; and a grab bar is secured i-non a rotation axis thereof between the facing walls, a first end thereof engaging with a first one of the engaging elements and a second end thereof engaging with a second one of the engaging elements, the engaging elements facing each other on the rotation axis of the grab bar at a distance from said external surface of said front wall.

* * * * *